US006158837A

United States Patent [19]

Hilton et al.

[11] Patent Number: 6,158,837

[45] Date of Patent: Dec. 12, 2000

[54] PRINTER HAVING PRINT MODE FOR NON-QUALIFIED MARKING MATERIAL

[75] Inventors: Brian S. Hilton, Rochester; Eric A. Merz, Webster; Frederick A. Donahue, Walworth, all of N.Y.

[73] Assignee: Xerox Corporation, Stamford, Conn.

[21] Appl. No.: 08/934,547

[22] Filed: Sep. 19, 1997

[51] Int. Cl.[7] ..... B41J 29/393

[52] U.S. Cl. ..... 347/19

[58] Field of Search ..... 347/19, 23, 14

[56] References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezanka | 346/140 |
| 4,771,295 | 9/1988 | Baker et al. | 346/1.1 |
| 4,961,088 | 10/1990 | Gilliland et al. | 355/206 |
| 5,021,828 | 6/1991 | Yamaguchi et al. | 355/209 |
| 5,049,210 | 9/1991 | Arthur et al. | 347/19 |
| 5,132,711 | 7/1992 | Shinada et al. | 347/19 |
| 5,160,945 | 11/1992 | Drake | 346/140 |
| 5,185,614 | 2/1993 | Courian et al. | 346/1.1 |
| 5,198,054 | 3/1993 | Drake et al. | 156/64 |
| 5,283,613 | 2/1994 | Midgley, Sr. | 355/203 |
| 5,289,210 | 2/1994 | Takayanagi | 347/14 |
| 5,365,312 | 11/1994 | Hillmann et al. | 355/206 |
| 5,486,855 | 1/1996 | Carlotta et al. | 347/87 |
| 5,519,425 | 5/1996 | Dietl et al. | 347/87 |
| 5,534,902 | 7/1996 | Hoesly | 347/104 |

*Primary Examiner*—John Barlow
*Assistant Examiner*—Charles W. Stewart, Jr.

[57] ABSTRACT

An ink jet printer of the type having at least one customer replaceable ink cartridge with an ink monitoring system detects whether or not the ink in the cartridge contains qualified ink or not and adjusts the normal printing mode to a non-normal printing when non-qualified ink is detected, thereby providing the customer the option to print with non-qualified ink with minimized effect on the printer or print quality.

14 Claims, 9 Drawing Sheets

PRINTER HAVING PRINT MODE FOR NON-QUALIFIED MARKING MATERIAL

BACKGROUND OF THE INVENTION

The invention relates to printing devices and more particularly to ink jet printers using customer replaceable ink supply cartridges having electronic monitoring devices to detect whether competitor supplied cartridges or competitor refilled cartridges containing non-qualified ink have been installed and, if detected, to adjust the printing mode of the printer in order to minimize the effect of non-qualified inks on the printer.

For the convenience of the end users or customers of printers, such as copiers, facsimile machines, and ink jet printers, customer replaceable marking material supply containers, typically referred to as cartridges, are used which may be removed and replaced by the customer when the marking material therein is depleted. The marking material may be xerographic toner or liquid ink, depending upon the type of printer. In one existing printer embodiment, the customer replaceable cartridge contains an integral printhead as well as the ink and the combined cartridge and printhead may be discarded when the ink is depleted. In another type of existing customer replaceable cartridge, only ink is contained therein and the printhead is separately provided. For reciprocating carriage type ink jet printers, the cartridges are readily installed on or removed from the printer carriage by the customer. For full width array ink jet printers, the printhead is fixedly mounted in the printer and extends for the width of a recording medium to accommodate printing across the complete width of the recording medium as it is moved past the printhead. The ink cartridges for full width array printers contain only ink and usually contain larger supplies of ink than the carriage type printer cartridges. For an example of a carriage type ink jet printer with a customer replaceable cartridge refer to U.S. Pat. No. 5,519,425, and for an example of a full width array type ink jet printer refer to U.S. Pat. No. 5,160,945 and U.S. Pat. No. 5,198,054.

Typically, printers are designed for specially formulated marking material. Thermal ink jet printing devices, as an example, are designed for specifically formulated inks, termed 'qualified' inks, and for specific printing modes to control ejected droplet sizes, droplet velocity, material compatibility, particular cleaning and priming techniques, droplet ejection rates, and other functions. Many problems may arise with the printers when specifically qualified inks are replaced with a non-qualified ink by the customers. For example, heating elements may be damaged and fail early, print quality may be lower, and the printheads and/or maintenance stations may be corroded by the non-qualified inks. The printers and printheads are usually provided with a warranty for a particular lifetime, rate of ink consumption, and print quality. Since the use of a non-qualified ink in thermal ink jet printers is highly likely to affect the printer's performance and lifetime in the printer's normal printing mode, printer manufacturers generally discourage use of non-qualified inks and void warranties when they are used. The price of non-qualified inks are usually lower in price than the qualified inks, so customers are tempted to use them at least some of the time, especially when ink-depleted cartridges by the same manufacturer are refilled with the non-qualified ink.

U.S. Pat. No. 4,961,088 discloses a system for monitoring customer replaceable cartridges in printers or copiers. Each replaceable cartridge includes an electrically erasable programmable read only memory (EEPROM) which is programmed with a cartridge identification number that when matched a cartridge identification number in the printer or copier enables the printer or copier to operate, provides a cartridge replacement warning count, and provides a termination count at which the cartridge is disabled from further use. The EEPROM is programmed to store updated counts of the remaining number of images or prints available by the cartridge after each print or copy is made by the printer or copier.

U.S. Pat. No. 5,021,828 discloses a replaceable unit for use in a copier or printer in which initial use and near-end-of-life is recorded by electrical means, including a portion itself removable from the removable unit, comprising two fuses. A first fuse is blown when a few copies have been made with the replaceable unit, and the second fuse is used to prevent further use of the replaceable unit when a certain number of copies or prints have been made with the replaceable unit.

U.S. Pat. No. 5,283,613 discloses a monitoring system for replaceable cartridges in a printer or copier, including an electronic count memory and an electronic flag memory. The count memory maintains a one-by-one count of prints made with the cartridge. The flag memory includes a series of bits which are alterable from a first state to a second state but not alterable from the second state to the first state. The bits in the flag memory are altered at predetermined intervals as prints are made with the cartridge. The flag memory is used as a check to override unauthorized manipulation of the count memory.

U.S. Pat. No. 5,365,312 discloses replaceable ink reservoirs, ribbon cassettes, or toner cartridges having an electronic memory means in the form of a chip in which information is stored about the current fill status of the reservoir and other status data that are relevant for printer operation. The used status of the ink or other printing medium is acquired from the controller of the printing machine and is communicated to the chip. The chip on the reservoirs counts consumption until the supply is exhausted to such an extent the reservoir must be replaced. A reprogramming of the chip and refilling of the reservoir is not possible.

SUMMARY OF THE INVENTION

It is an object of the invention to enable optional use of customer replaceable marking material supply cartridges containing non-qualified marking material in a printer with minimized adversed effect on the printer by adjusting the printing mode thereof and with concurrent notice that printing with the non-qualified marking material is outside the printer warranty and that all such events are stored in a printer memory.

In one aspect of the invention, there is provided a method for adjusting the print mode of a printer using a customer replaceable marking material supply cartridge in response to a detection of a non-qualified marking material in the cartridge by an electronic monitoring system, comprising the steps of: (a) reading an identification number on a customer replaceable marking material supply cartridge after installation thereof in the printer; (b) comparing the identification number which has been read with identification numbers stored in a controller memory of the printer; (c) identifying matches and non-matches between said customer replaceable cartridge identification number and said stored identification numbers; (d) displaying a warranty or an out-of-warranty condition on a display panel for the printer when matches or non-matches are respectively identified; (e) causing a non-normal printing mode for the printer, which adjusts printing parameters thereof to minimize any damaging effect of the non-qualified marking material on the printer, when the printer is actuated for printing and an out-of-warranty condition is displayed on the display panel; and (f) automatically logging a use of a non-normal printing mode in the controller memory of the printer, thus enabling the optional use of a cartridge containing a non-qualified marking material.

In another aspect of the invention, the method of adjusting the print mode of the printer further comprises the steps of: (g) determining a marking material level in said cartridge by an electronic monitoring system and displaying an available usage remaining for the customer replaceable cartridge on the display panel when the printer is actuated for printing and a warranty condition is displayed; (h) causing a normal printing mode for the printhead, if the available usage displayed is greater than zero, and preventing the printer from initiating printing under warranty conditions, if the available usage displayed is zero; (i) converting the warranty condition displayed to an out-of-warranty condition displayed, if the available usage displayed is zero, and changing the identification number on the customer replaceable cartridge to prevent further matches with the stored identification numbers; (j) providing an option of printing with a cartridge which has been at least partially refilled with a non-qualified marking material; (k) enabling the non-normal printing mode for the printer, when the printhead is actuated for printing and an out-of-warranty condition is displayed; and (l) automatically logging a use of a non-normal printing mode in the controller memory of the printer.

BRIEF DESCRIPTION OF THE DRAWINGS

The present invention will now be described by way of example with reference to the accompanying drawings, wherein like reference numerals refer to like elements and in which.

DESCRIPTION OF THE PREFERRED EMBODIMENT

The present invention is applicable for any multifunction printer or marking engine, such as a copier, facsimile machine, or ink jet printer, which uses liquid or dry marking material in a customer replaceable cartridge. However the invention will be described in the environment of an ink jet printer.

Figure 1:
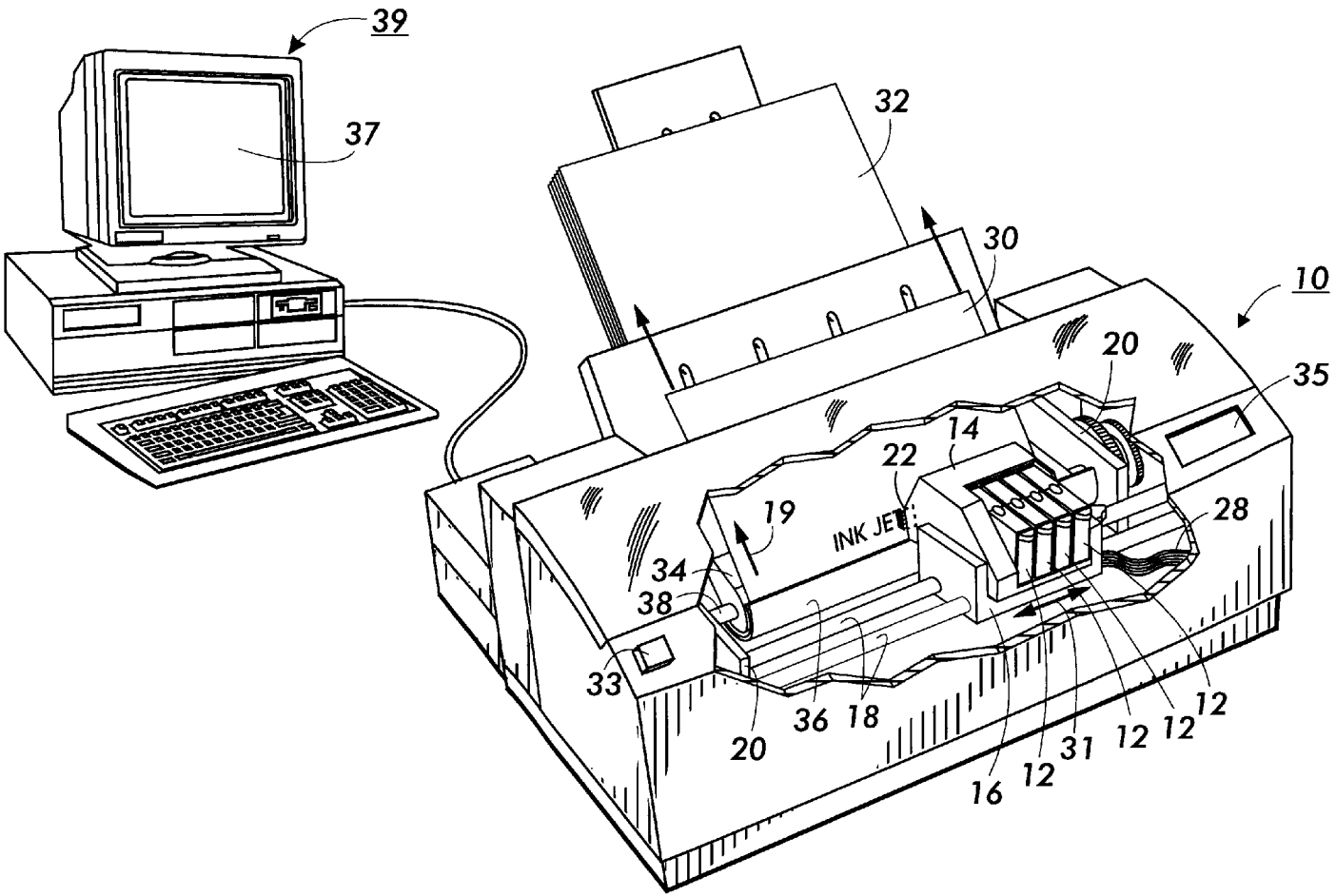
FIG. 1 is an isometric view of a carriage type color ink jet printer having a customer replaceable printhead and separate customer replaceable ink supply cartridges of the present invention.

FIG. 1 illustrates an isometric view of a carriage type, multicolor thermal ink jet printer 10, including personal computer 39 connected thereto, having a normal printing mode for qualified ink and a non-normal printing mode for non-qualified ink. The printer incorporates an electronic monitoring system for customer replaceable ink supply cartridges, sometimes referred to as a Customer Replaceable Unit Monitoring System or CRUM system, described later. The printer includes four replaceable ink supply tanks or cartridges 12 mounted in a removable ink jet printhead assembly 14. The ink supply tanks or cartridges may each have a different color of ink, and in the preferred embodiment, the tanks have yellow, magenta, cyan, and black ink. The printhead assembly is installed on a translatable carriage 16 which is supported by carriage guide rails 18 fixedly mounted in frame 20 of the printer. The carriage is translated back and forth along the guide rails by any suitable means (not shown), such as timing belt driven by an electrical motor, as is well known in the printer industry. The carriage is under the control of the printer controller 21, shown in FIG. 5.

Figure 2:
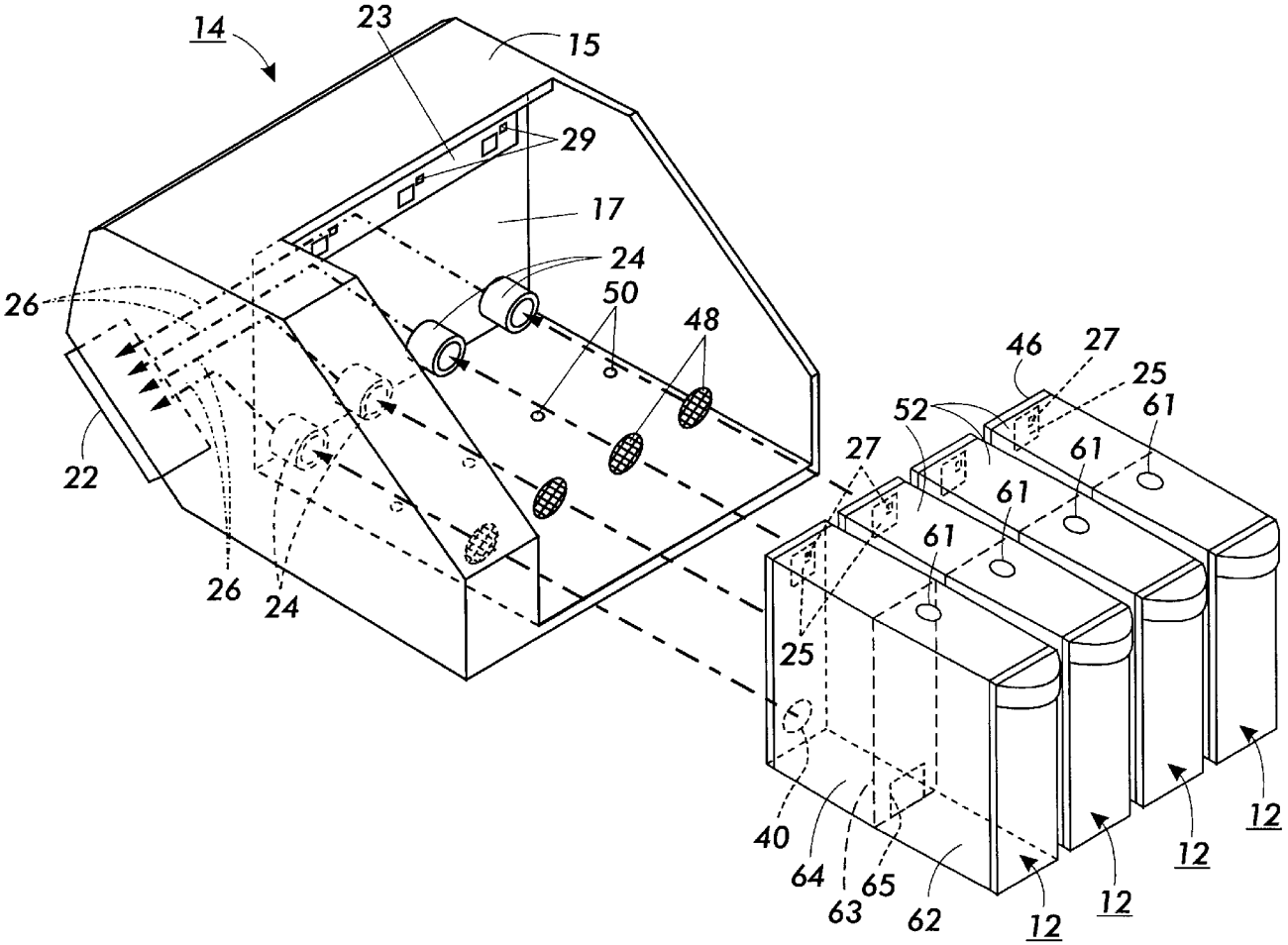
FIG. 2 is a partially exploded isometric view of the customer replaceable printhead and cartridges of FIG. 1.

Referring also to FIG. 2, the printhead assembly 14 comprises a housing 15 having an integral multicolor ink jet printhead 22 and ink pipe connectors 24 which protrude from a floor 17 of the printhead assembly for insertion into the ink supply cartridges 12 when the ink supply cartridges are installed in the printhead assembly housing. The protruding ink pipe connectors are usually covered by a wire mesh filter 48 to prevent particles or debris from the cartridge from being carried by the ink into the printhead. Ink flow paths, represented by dashed lines 26, in the housing interconnects each of the ink pipe connectors with the separate inlets of the printhead. The printhead assembly on which the replaceable ink supply tanks or cartridges are mounted, includes an interfacing printed circuit board 23 that is connected to the printer controller by ribbon cable 28 through which electric signals are selectively applied to the printhead to selectively eject ink droplets from the printhead nozzles (not shown). The multicolor printhead 22 contains a plurality of ink channels with heating elements therein (neither shown) which carry ink from each of the cartridges to respective groups of ink ejecting nozzles of the printhead. Identification and memory chips 25 with contact pads 27, shown in dashed line, are bonded to the bottom wall 46 of the cartridges 12, so that when the cartridges are installed in the printhead assembly 14, the chip contact pads 27 mate with and couple to the contact pads 29 of the printed circuit board 23 to complete the electrical connection with the printer controller. The chips 25 in the preferred embodiment are electrically erasable programmable read only memories or EEPROMs which when electrically integrated with the printer controller form the CRUM system of the present invention, described below.

When printing, the carriage 16 reciprocates back and forth along the guide rails 18 in the direction of arrow 31. As the printhead 22 reciprocates back and forth across a recording medium 30, such as single cut sheets of paper fed from an input stack 32 of sheets, droplets of ink are expelled from selected ones of the printhead nozzles towards the recording medium 30. The nozzles are typically arranged in a linear array perpendicular to the reciprocating direction of arrow 31. During each pass of the carriage 16, the recording medium 30 is held in a stationary position. At the end of each pass, the recording medium is stepped in the direction of arrow 19 for a distance equal to the height of a printed swath. For a more detailed explanation of the printhead and the printing thereby, refer to U.S. Pat. No. 4,571,599 and U.S. Pat. No. Re 32,572, the relevant portions of which are incorporated herein by reference.

A single sheet of recording medium 30 is fed from the input stack 32 through the printer along a path defined by a curved platen 34 and a guide member 36. The sheet is driven along the path by a transport roller 38 as is understood by those skilled in the art or, for instance, as illustrated in U.S. Pat. No. 5,534,902, incorporated herein by reference. As the recording medium exits a slot between the platen 34 and guide member 36, the sheet 30 is caused to reverse bow such that the sheet is supported by the platen 34 at a flat portion thereof for printing by the printhead 22.

With continued reference to FIG. 2, ink from each of the ink cartridges 12 is drawn by capillary action through the outlet port 40 in the ink cartridges, the ink pipe connectors 24, and ink flow paths 26 in the printhead assembly housing to the printhead 22. The ink pipe connectors and flow paths of the housing supplies ink to the printhead ink channels, replenishing the ink after each ink droplet ejection from the nozzle associated with the printhead ink channel. It is important that the ink at the nozzles be maintained at a slightly negative pressure, so that the ink is prevented from dripping onto the recording medium 30, and ensuring that ink droplets are placed on the recording medium only when a droplet is ejected by an electrical signal applied to the heating element in the ink channel for the selected nozzle. A negative pressure also ensures that the size of the ink droplets ejected from the nozzles remain substantially constant as ink is depleted from the ink supply cartridges. The negative pressure is usually in the range of −0.5 to −2.0 inches of water. One known method of supplying ink at a negative pressure is to place within the ink supply cartridges an open cell foam or needled felt in which ink is absorbed and suspended by capillary action. Ink tanks which contain ink holding foam are disclosed, for example, in U.S. Pat. No. 5,185,614; U.S. Pat. No. 4,771,295; and U.S. Pat. No. 5,486,855.

As mentioned before, inks are specifically formulated to provide satisfactory performance in a particular ink jet printer. The ink compositions are fine tuned to meet particular refill rates of the printhead, drying time on the recording medium, droplet ejection rate or firing frequency, materials compatibility, etc. Such an ink is termed 'qualified' by the manufacturer and will satisfactorily perform in the printer, and it is with qualified inks that the printer performance and print quality is warranted by the manufacturer. In order to assure that only qualified inks are used to print in the normal or warranted printing mode of an ink jet printer, for which the quality and performance is guaranteed under a limited warranty, each ink cartridge has a chip 25 attached thereto that includes an electrically erasable programmable read only memory (EEPROM). To enable the memory to be electrically connected and disconnected with the printer controller on installation and removal of the ink cartridge 12, contact pads 27 are provided on the chip and a printed circuit board 23 with corresponding contact pads 29 are mounted on the printhead assembly in a manner similar to that described in U.S. Pat. No. 5,283,613, incorporated herein by reference.

The ink supply cartridge 12 for a carriage type ink jet printer 10 comprises a housing 52 of any suitable material, such as, for example, polypropylene, having first and second compartments 62,64 which are separated by a common wall 63. A qualified ink is stored in the first compartment 62. The ink is introduced into the first compartment through ink inlet 61 which is subsequently covered. The second compartment 64 has an open cell foam member (not shown) inserted therein. Ink from the first compartment moves through aperture 65 in the common wall 63 to saturate the foam member with ink. The foam member is inserted into the second compartment through the open bottom thereof, and then the open bottom is covered by a bottom wall 46 of the same material as the housing 52. The bottom wall 46 has the open outlet port 40 and is heat staked to weld it to the housing 52 after the foam member is inserted. Next, the chip 25 is positioned and bonded to the bottom wall.

Figure 5:
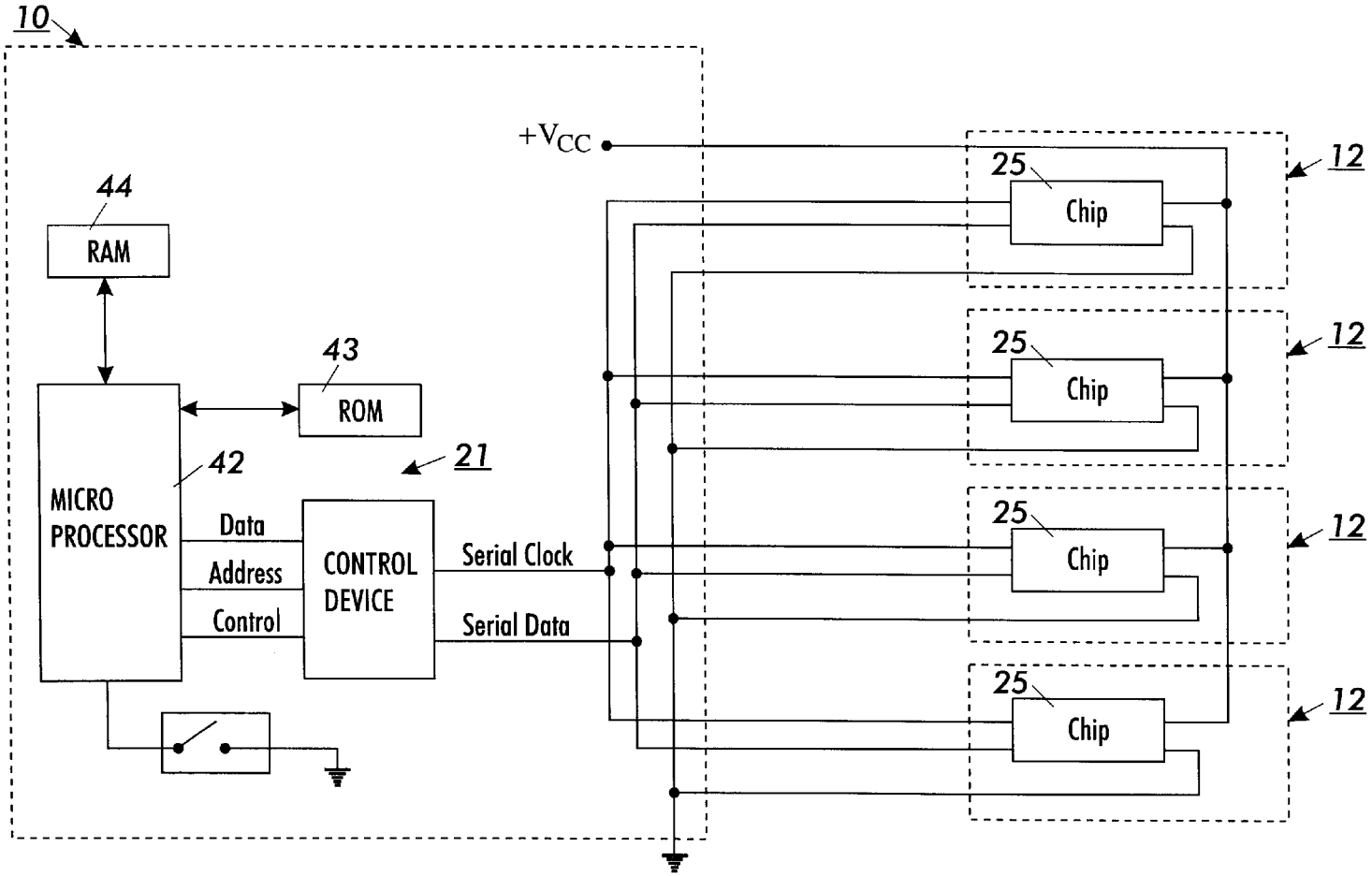
FIG. 5 is a schematic representation of the printer controller and interconnected chips mounted on the customer replaceable ink cartridges.
Figure 6:
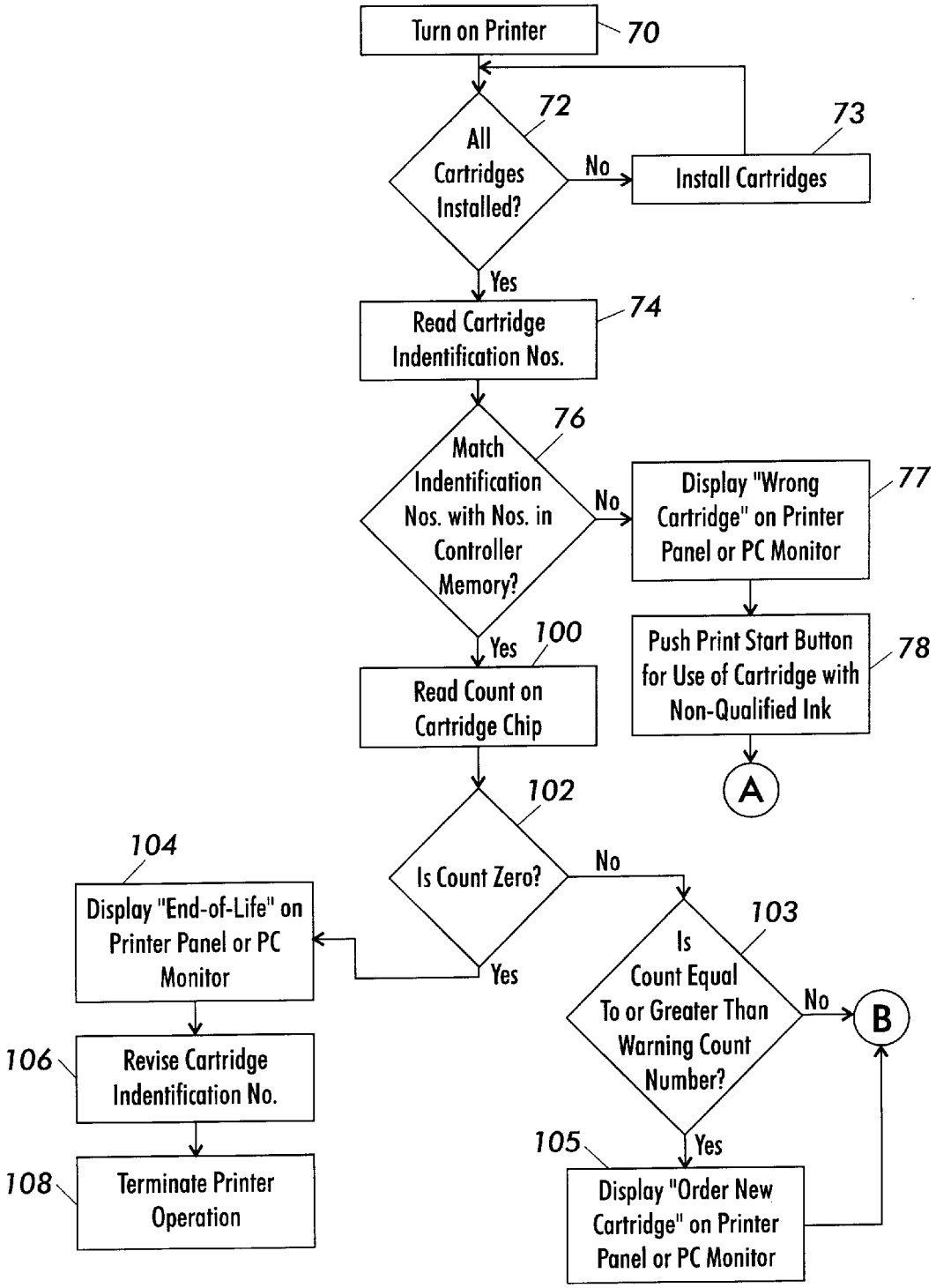
FIGS. 6–9 are flow charts depicting the monitoring system for detecting cartridges having non-qualified ink and the automatic adjustment of the normal printing mode of the printer to minimize the detrimental effects of the non-qualified ink on the printer.
Figure 7:
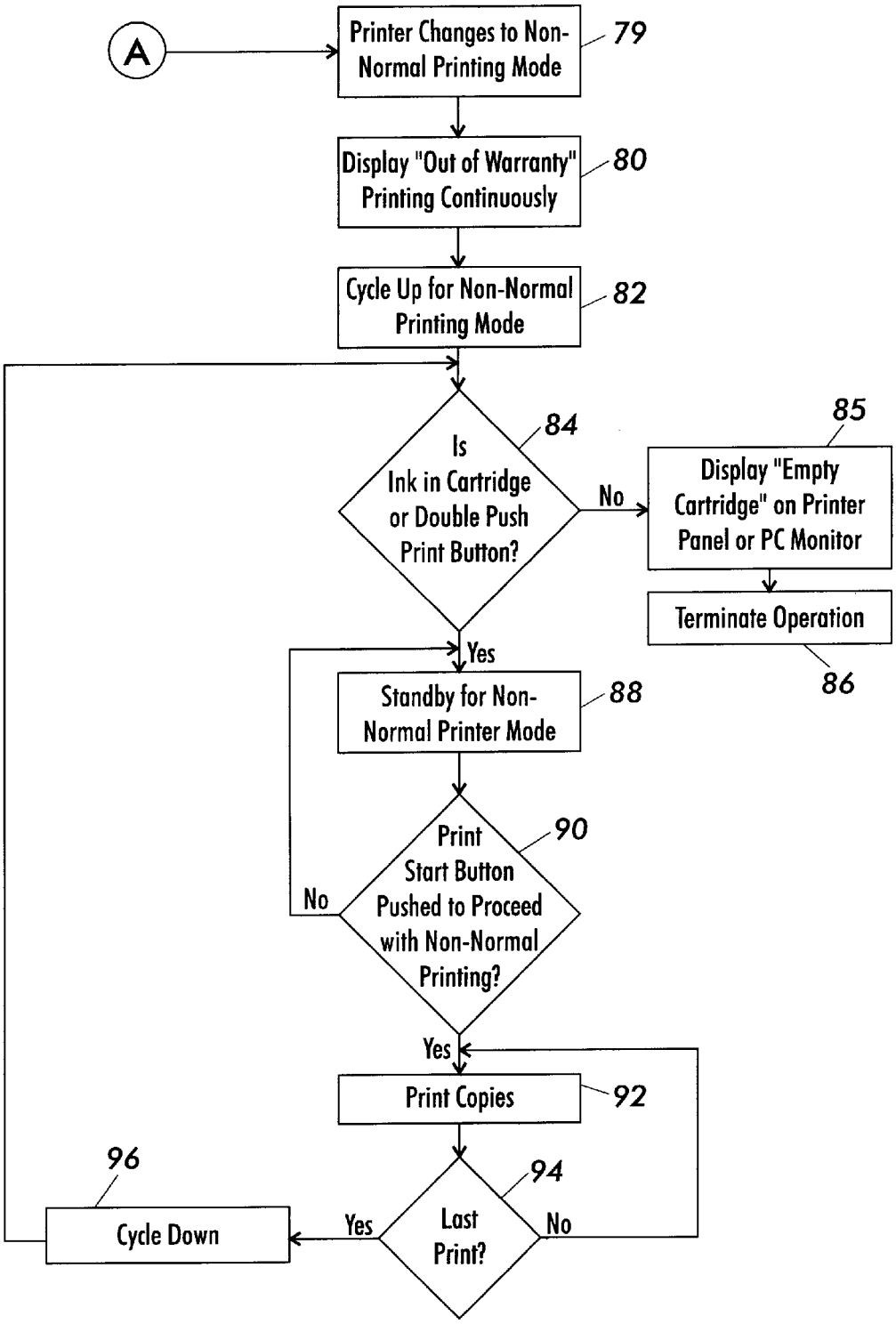
Figure 8:
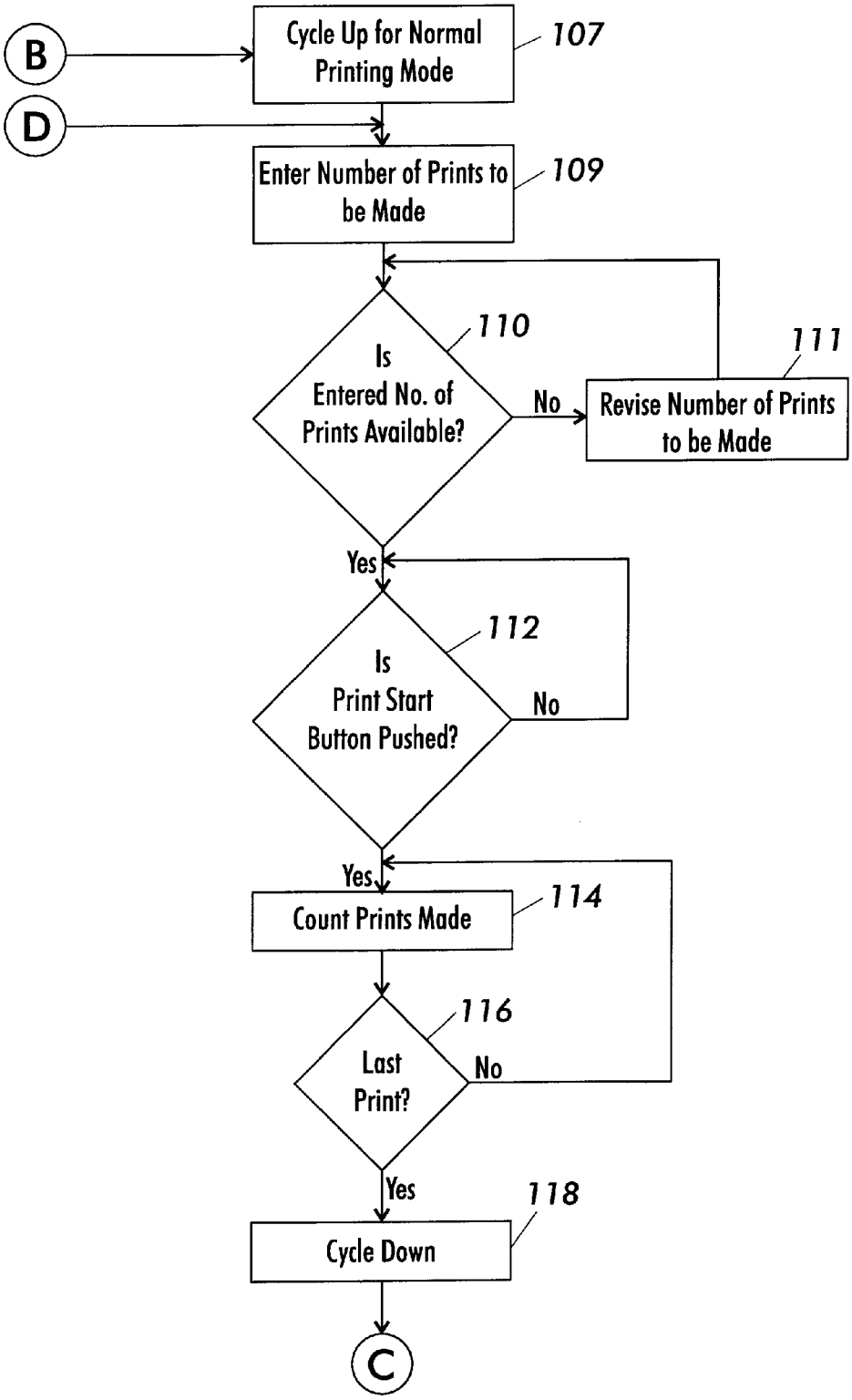
Figure 9:
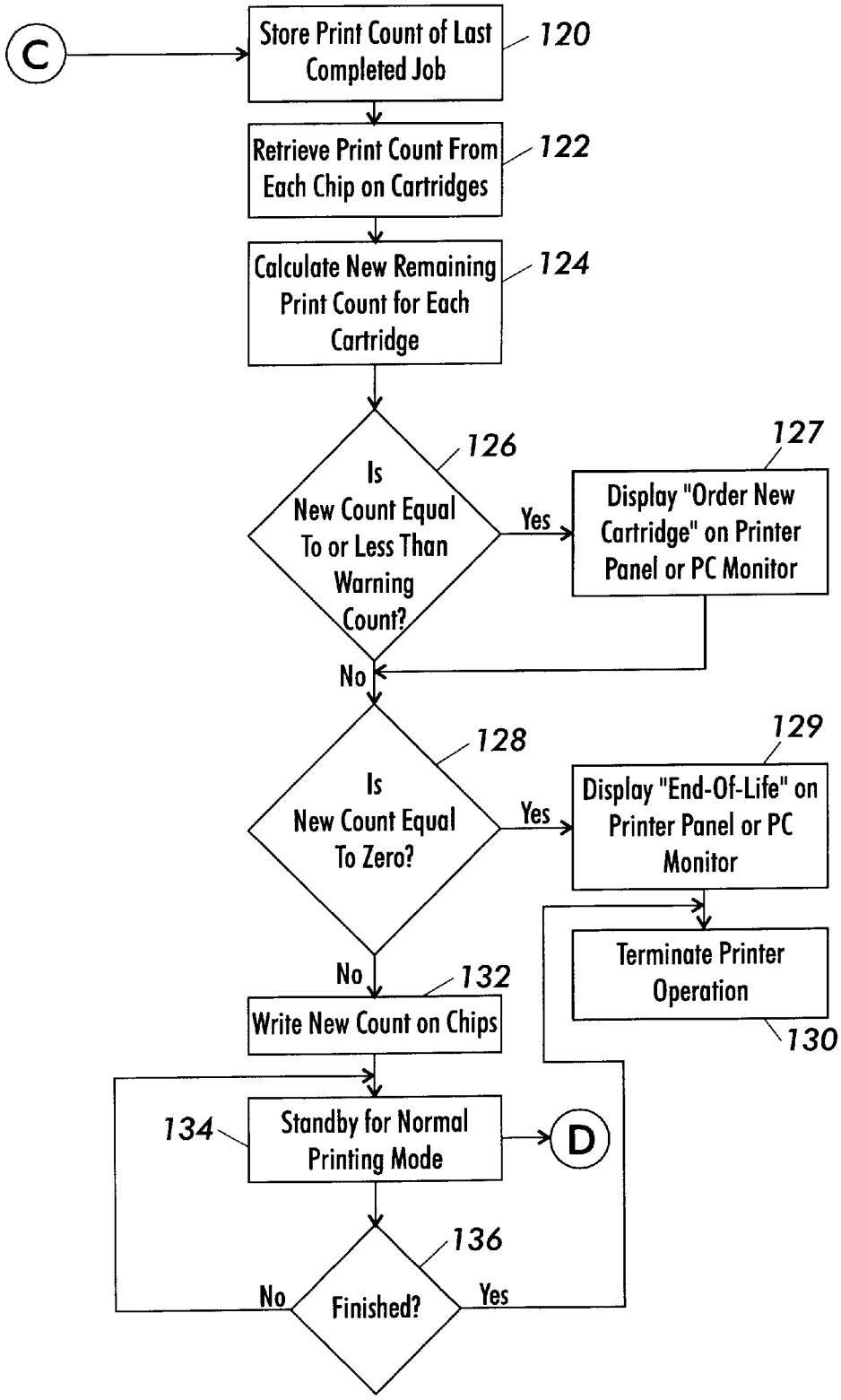

In Fig. 5, a multicolor ink jet printer 10 with four cartridges 12 containing different ink colors are represented by dashed line enclosures. In printer 10, a suitable printer controller 21 is depicted which includes one or more microprocessors 42 and a suitable memory, such as a Read Only Memory (ROM) 43 and Random Access Memory (RAM) 44, for holding the printer operating system software, programming data, etc. The printer controller 21 operates the various component parts of the printer in an integrated fashion to produce high quality images on the recording medium 30. The chip 25 for each cartridge 12 has an identification number and provides addressable memory for storing or logging a count of the number of sheets of recording medium still available for printing by each cartridge, the count of the remaining number of sheets of recording medium that can be printed with average ink coverage is stored on the various memories by the printer controller at the end of each print job. Each chip (EEPROM) is pre-programmed with a maximum count reflecting the maximum number of recording sheets that can be printed by the cartridge, as estimated by the average number of ink droplets printed on an average sheet. The counting system is a decrementing type system with the maximum count in the chips being decremented after the total print job is completed. The total droplets used to produce the images are counted as they are printed on each sheet to provide a current effective sheet count.

When the current estimated number of recording medium sheets is zero, the cartridge is rendered unusable for normal printing, so that it must be discarded or refilled. Because it is detrimental to the heating elements in the printhead to be fired or energized without ink being in the printhead channels, a small amount of unusable ink is left in the cartridge. Once the cartridge has used up the pre-programmed maximum count, this information is displayed on the display panel 35 of the printer or monitor 37 of an associated personal computer 39 and any attempt to further use it is not permitted unless it is first removed and then replaced thereby permitting refilling if desired by the customer. A reinstallation of a cartridge which has been depleted of ink, even if refilled, causes an 'out-of-warranty' signal, so that use of the refilled cartridge is possible by the customer, though not recommended. A refilled cartridge is always identified as containing non-qualified ink, but may be used to print by the customer in a non-normal print mode, automatically provided by the operating software as described later with respect to FIGS. 6–9, by pushing the printer's start button 33. The non-normal printing mode is provided with the caveat that such use is out side of the warranty. However, the non-normal printing mode has been designed to minimize the potential detrimental effects of the non-qualified ink. The non-normal mode entails a slower firing frequency and slower printing speed to prevent the printhead ink channels from being starved of ink which would damage the heating elements and to enable the non-qualified ink more time to dry on the recording medium. In addition, the non-normal printing mode causes the cleaning step to be repeated to assure a clean nozzle face (not shown) on the printhead and the priming step is changed to cause 50% more ink to be suctioned than is removed during a normal print mode priming operation to assure that no bubbles remain in the printhead which will effect print quality or damage to the printhead.

To alert or warn the customer when the cartridge is nearing the end of life, a warning count number reflecting the predetermined number of remaining sheets of recording medium that may be printed by the cartridge is also provided in the memories of the chip. When the warning count number is reached, a message is displayed on the display panel 35 of the printer or on the monitor 37 of the associated personal computer 39 connected thereto, so that the customer is warned that a particular one of the cartridges currently in use is nearing end of life and should soon be replaced. Typically, the warning count number provides at least a few hundred sheets of recording medium to be printed with an average number of ink droplets per sheet. Accordingly, the actual number of pages left is based upon the area coverage of each of the remaining sheets printed.

The maximum count number and warning count number are typically pre-programmed by the manufacturer at the factory. Additionally, in order to assure that only authorized chips and cartridges are used, an identification number is also pre-programmed and stored in the chip memories of each cartridge. In a well known manner, such as disclosed in U.S. Pat. No. 5,283,613, the identification numbers of the cartridges are read and compared with the corresponding recognition numbers stored in the memory of the printer controller upon each installation thereof. Where the identification number of any cartridge does not match any of the recognition numbers for that cartridge, an out-of-warranty condition is displayed on the printer panel or associated monitor and initiating printing by actuation of the print start button 33 will cause the printer to print in the non-normal print mode. All printing events in the non-normal printing mode is logged in the printer controller memory and can be accessed by a technical representative during either repair or routine maintenance, so that a complaint under warranty can be verified. Repairs for any damage or impaired print quality caused by out-of-warranty or non-qualified ink may be refused by the supplier or manufacturer, though the non-normal printing mode should adequately protect the printer from serious harm. Once a cartridge has been depleted of usable qualified ink, the identification number for the cartridge may be changed by software program, so that reinstallation will cause an out-of-warranty display, thereby causing any such refilled cartridge to be used for printing only in the non-normal printing mode.

Assuming that the correct cartridge is installed, a check is made to see if the cartridges have reached the end of life and if not at the end of life, then displaying the remaining count of sheets of recording medium that the cartridge can print. For this, the current count of remaining printed sheets of recording medium to be printed that is logged in the memory of each chip is obtained and compared with the termination count of zero. Where the current count is equal to zero, the cartridge is depleted of usable ink and a message of 'empty cartridge' is displayed in the printer panel or associated monitor. Operation of the printer is prevented until the empty cartridge is replaced.

Many customers desire to use cheaper replacement cartridges or refilled cartridges containing non-qualified ink to save money, but presently are either prevented from doing so by known CRUM systems or must do so at the peril of seriously damaging the printer and voiding the warranty because the printer has only a normal printing mode for qualified inks. When a previously ink-depleted cartridge is reinstalled after being refilled with ink, the identification number is checked and the changed identification number causes an out-of-warranty signal to be displayed. A printing operation may be initiated by the customer with on 'out-of-warranty' notice being displayed by pushing the start button 33 on the printer which will automatically convert the printer to the non-normal printing mode, thereby enabling the customer to use the non-qualified ink with reduced, if not eliminated, likelihood of damaging the printer. If a competitor's cartridge is installed which has no identification number or has an identification number which is not recognized, a 'wrong cartridge' signal is displayed and the customer may, nevertheless, print with it, but in the non-normal printing mode. Each non-normal printing mode operation is logged in the memory of the printer controller for access by the service provider or technical representative through, for example, a printout by the printer onto a sheet of recording medium or message printed on the display panel or monitor. Assuming that the cartridge identification number is recognized and has not reached its end of life, i.e., not depleted its useful ink, the printer enters a standby state ready to make prints, with the number of equivalent printed sheets which can still be printed by the cartridge displayed for the convenience of the customer.

On a print request when the printer is in the standby state for the normal printing mode, the printer cycles up by performing a set sequence of events to assure that the first printed sheet of recording medium will have the warranted print quality for the normal printing mode printing, such as, for example, firing a few test droplets at the maintenance station to clear the nozzles and clean the nozzle face with a blade as the printhead is traversed from the maintenance station to the printing location. The printer also enters a standby state to make prints in the non-normal printing mode, but on a print request, the startup sequence is revised according to the software program in the printer controller for the non-normal printing mode, which entails, for example, more test droplets and additional cleaning steps, generally doubling the number of times that the nozzle face is cleaned during a normal printing mode. During non-normal printing, the firing or droplet ejection rate is reduced to provide appropriate refill time and the speed of printing is reduced to enable more drying time for the printed sheets.

In the normal printing mode, the printer controller counts each time a droplet is ejected from nozzles connected to its respective ink supplying cartridge, so that for each allotted quantity of ejected droplets representing a printed sheet of recording medium, the chip memory will be decremented by one when the printing job is completed, so that an accurate number of remaining sheets available to be printed by the cartridge is maintained in the chip for the respective cartridge. When the print job is completed and the printer is cycled down to the standby state, the total number of equivalent average sheets is temporarily stored in the printer controller and then this total number of equivalent average printed sheets is decreased from that existing in the chip memory by means well known in the industry.

In the non-normal printing mode, the tracking of the ink status in the cartridge is not possible, for the cartridge does not have a usable chip. To prevent the possible use of an empty cartridge which might cause the firing of a heating element without ink, a photosensor 50 (see FIG. 2) may be optionally provided to sense the absence of ink in any one of the cartridges and terminate the operation of the printer to prevent life threatening damage to the printhead assembly 14. Alternatively, the customer must repush the start print button when the printer display panel 35 or personal computer monitor 37 displays 'is ink in cartridge?' to signify or confirm that the cartridges each contain ink and permit continued printing in the non-normal printing mode. Generally the ink cartridges are transparent or otherwise provide means for visually determining that ink is present in the cartridge.

In the normal printing mode, the updated remaining count in the chip memory is compared to the warning count number stored in the chips of each cartridge. Where the new current count of sheets available to be printed is equal to or less than the warning count, usually about one hundred sheets, a message is displayed for the particular cartridge in the printer panel or associated monitor to 'Order New Cartridge'. This alerts the customer of the fact that the identified cartridge is about to be depleted of usable ink and that a replacement should be available. The updated remaining count in the chip memory is also compared with the termination count of zero. Where the new current count of sheets available to be printed is zero for a cartridge, the cartridge chip causes a display of 'empty cartridge' on the printer panel or associated monitor, changes the identification number thereof, and prevents further use of this cartridge by the printer, except in the non-normal printing mode. Henceforth, the cartridge which has once been depleted of ink will permit only non-normal printing modes and a display of 'out-of-warranty' during subsequent printing, each of which event is also stored in the printer controller memory for access by a service provider. The memory in each chip mounted on the cartridges is of the type which can only be decremented and cannot be revised by a customer to add count of available sheets which can be printed by the cartridge. One example of a memory which cannot be revised upwardly is disclosed in U.S. Pat. No. 5,283,613, which is incorporated herein by reference.

FIGS. 6–9 are flow charts showing the operation of a control system for a printer having a normal printing mode and a non-normal printing mode. The non-normal printing mode enables a customer to have the option of using a cartridge with non-qualified ink and, though such printing is conducted in an out-of-warranty operation, it minimizes, if not eliminating, the potential detrimental effects thereof on the printer. Whenever the printer 10 is powered up by step 70, an initialization routine is entered in which the controller checks to see if all cartridges have been installed at step 72. If not, the missing cartridges are installed by the customer at step 73. If all cartridges are installed, the identification number of each cartridge is read at step 74 and checked for authorization at step 76 by comparing the numbers with the numbers stored in the printer controller memory for matches. If there are no identification numbers on the cartridges or there are no matches, the printer display panel 35 or personal computer monitor 37 displays "Wrong Cartridge" at step 77. If a competitor supplied cartridge is installed without an authorized identification number or a refilled cartridge with revised identification number is installed by the customer, then such cartridge is determined to contain non-qualified ink and may still be used but only in a non-normal printing mode as described before. To use a cartridge with non-qualified ink, the print start button 33 is pushed at step 78. The printer controller automatically changes the printing mode from the normal printing mode to the non-normal printing mode at step 79 and, at step 80, the printer display panel or personal computer monitor displays "Out-of-Warranty Printing" which remains displayed while printing in the non-normal printing mode. Next, at step 82, the printer controller cycles up the printer for non-normal printing, which includes ejecting a number of ink droplets at the maintenance station, usually twice the number for the normal printing mode, cleans the printhead nozzle face at least twice the number for normal printing, reduces the frequency of the droplet ejection (firing rate), and slows down the printing speed to provide more drying time for the printed sheets.

Because there is no chip to check the status or level of ink, the printer controller checks at step 84 if there is ink in the cartridge containing non-qualified ink, so that a cartridge depleted of ink will not cause the heating elements to fire when there is no ink in the printhead channels. Firing or energizing a heating element without the presence of ink could ruin the heating element. The customer must double push print start button to confirm that ink is present in the cartridges or, optionally, a photosensor 50 (FIG. 2) checks for ink. Usually the customer replaceable ink cartridges are transparent or otherwise provide means for visually observing ink level therein. If no ink is present or the print start button is not double pushed within a reasonable time period, the printer panel or monitor will display "Empty Cartridge" at step 85 and the operation of the printer will be terminated at step 86. If the presence of ink is established, the printer enters a standby of non-normal printing at step 88, awaiting the entry of the number of prints to be made and the pushing of the print start button at step 90. When the print start button is pushed, the printer starts making the prints at step 92 and queries for the last print at step 94. When the print job is completed, the printer is cycled down by moving the printhead assembly to a maintenance station and rechecks to see if ink is still available in the cartridges at step 96 before returning to the standby for the non-normal printing mode.

If the cartridge identification number is matched by the printer controller, the remaining number of sheets available to be printed by the cartridge is read at step 100 and compared to zero at step 102. If the remaining number of sheets available to be printed is zero, meaning no usable ink is left in the cartridge, the printer display panel or monitor displays "End-of-Life" at step 104 and revises the cartridge identification number at step 106, so that the cartridge can no longer be used, except in the non-normal printing mode. Next, the printer operation is terminated until a new or different cartridge is; installed at step 108.

If the count on the cartridge chip is greater than zero, the chip count is compared with a predetermined warning number at step 103 representing a small number of sheets left which can still be printed and indicating only a small amount of ink is left in the cartridge. The warning number is usually about 100 equivalent sheets of average ink coverage. When the chip number is equal to or less than the warning number, the printer display panel or monitor displays "Order New Cartridge" at step 105, and then causes the printer to perform a routine, generally referred to as cycling up, at step 107, which prepares the printhead assembly for the normal printing mode. If the chip number is larger than the warning number, the printer controller causes the printer to proceed directly with step 107. The cycling up process includes firing a few ink droplets at the maintenance station to clear out the printhead nozzles and clean the nozzle face by a cleaning blade as it leaves the maintenance station and proceeds to the printing location. The number of prints to be made is entered into the printer at step 109 by the customer and this number of prints is compared with the chip number at step 110. If the desired number of prints is greater than the number of prints available by the cartridge, the desired number of prints must be lessened or the cartridge replaced at step 111. When the number of desired prints can be accommodated by the cartridges and the print start button is pushed at step 112, the normal printing is initiated and the number of equivalent sheets are counted by counting the number of ink droplets ejected and as the number reaches the designated number for a sheet, the count of one sheet is entered into the printer controller memory, and so no until the print job is completed and a total number of equivalent sheets is logged in. Periodically, the printer controller checks for the last sheet being printed at step 116 and stops printing and performs a cycle down routine at step 118 when the last sheet is identified. The cycle down basically involves moving the printhead assembly to the maintenance station where it is capped to prevent the ink at the nozzles from drying out, a few droplets are ejected to clear little used nozzles, and the nozzle face is cleaned as the printhead assembly enters the maintenance station.

While the printer is performing the cycle down, the total print count is established in the printer controller memory at step 120, and the chip count number is retrieved from the chip at step 122. A new remaining count number is calculated for a new remaining number of equivalent sheets that can be printed by the cartridges at step 124. This new chip count number is compared first with the warning number at step 126 and if it is equal to or less than the warning number, but greater than zero, the printer display panel or monitor displays "Order New Cartridge" at step 127. Next, the chip count number is checked to see if it is equal to zero at step 128 and if it is the printer display panel or monitor displays "End-of Life" and the printer operation is terminated at step 130. If the new chip count number is greater than zero, the new count number is written on the chip at step 132 and the printer placed in standby for further printing in normal printing mode at step 134, where it is queried to see if the customer is at least temporarily finished with printing jobs and if new entries are not made for the next print job in a predetermined time period, the printer operation is terminated at step 130 or left in the standby condition if the customer is not through with the printer.

Figure 3:
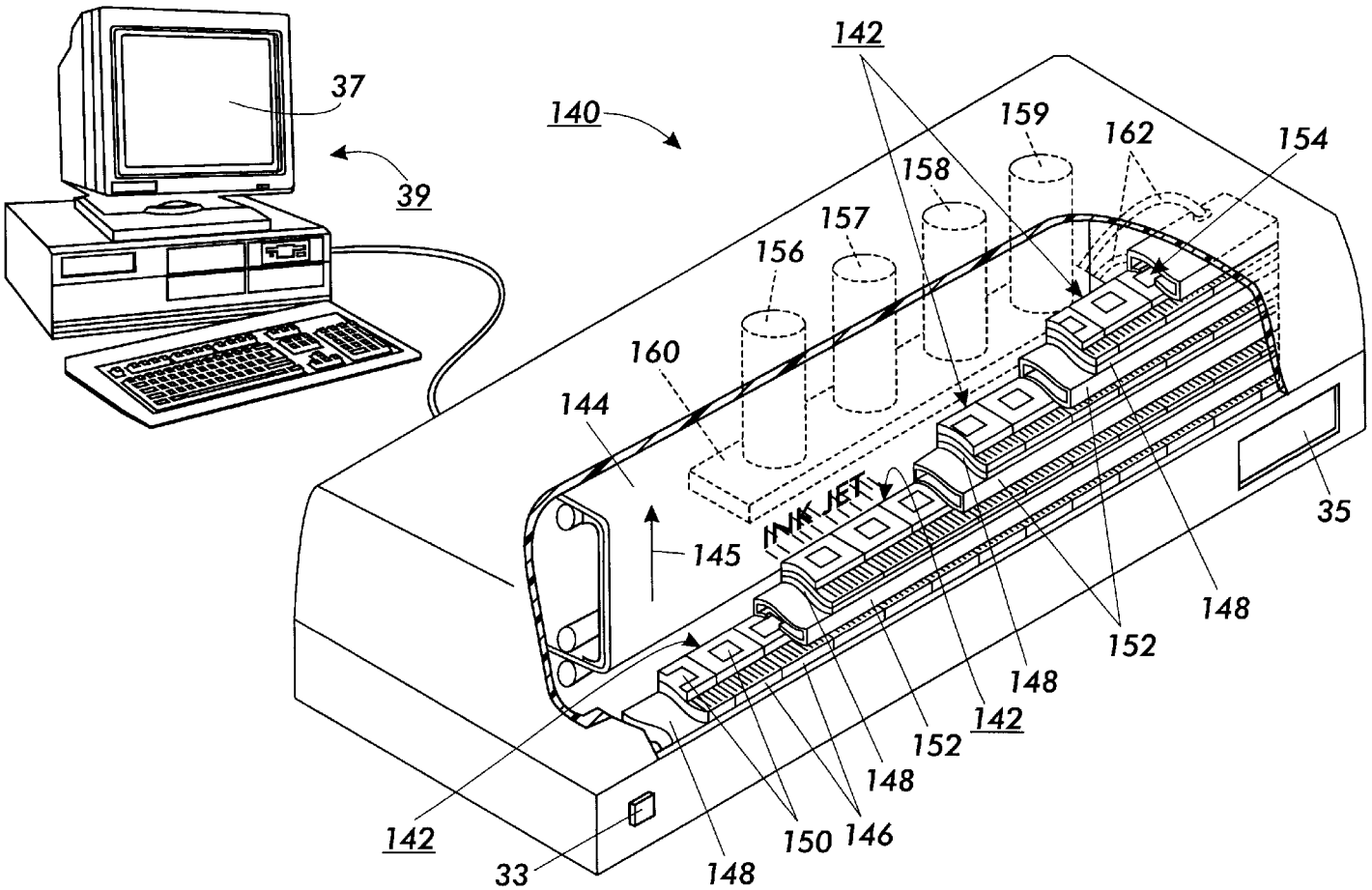
FIG. 3 is an isometric view of a full width array color ink jet printer having customer replaceable ink supply cartridges of the present invention.
Figure 4:
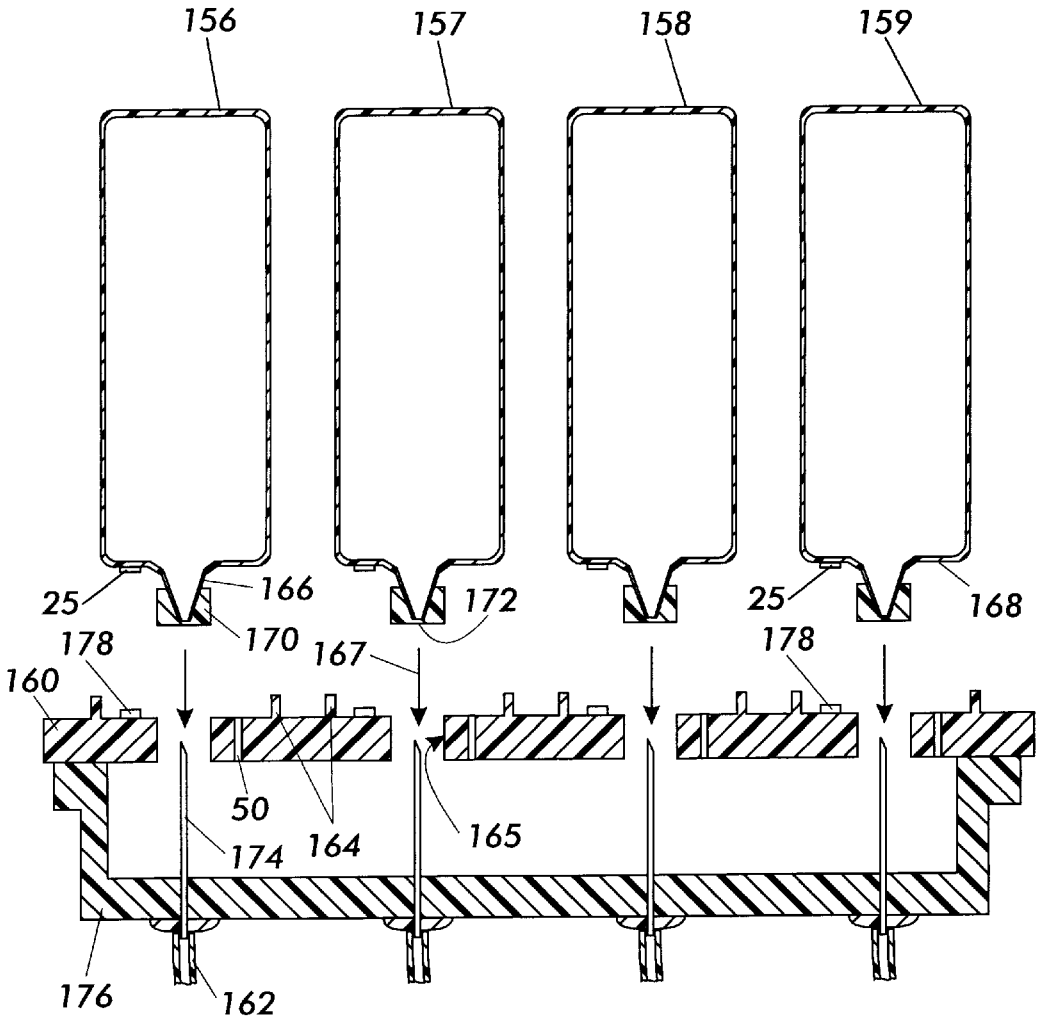
FIG. 4 is a partially sectioned, schematic elevation view of the customer replaceable ink cartridges shown in dashed line in FIG. 3.

The above described invention is equally applicable for full width array ink jet printers 140, such as shown in FIGS. 3 and 4. The full width array printer has four identical stationary printbars 142, similar to those described in U.S. Pat. No. 5,198,054, the relevant portions of which are hereby incorporated by reference. The printbars each have a different color of ink and are stacked one over the other with the side nozzles (not shown) of each printbar confronting the recording medium 144 which moves therepast at a constant velocity in the direction of arrow 145. In addition, the nozzles of each printbar are in alignment with each other for color registration. Each printbar is comprised of abutted printhead subunits 146 on a support substrate 148. Each subunit has an ink inlet 150 and a common ink manifold 152 is mounted thereon with outlet ports 154 which are aligned and sealed with respective subunit ink inlets 150. The support substrate of each printbar above the lowest printbar 142' resides on or close to the ink manifold of the printbar immediately below it. Relatively large ink containing cartridges 156, 157, 158, and 159, each with a different color of ink, pare shown in dashed line mounted on a fixed shelf 160 in the printer and each connected to a respective one of the ink manifolds by a separate flexible tube 162. As with the carriage type ink jet printer 10, the full width array printer 140 has a person computer 39 with monitor 37, an optional display panel 35, and print start button 33.

Referring to FIG. 4, a schematic, partially sectioned, elevation view of the four customer replaceable ink cartridges 156, 157, 158, 159 are shown separated from the fixed shelf 160. The shelf contains receptacles 164 to hold releasably the cartridges and each receptacle has an opening 165 through which the cartridge neck 166 extends when the cartridges are installed in the directions of arrows 167. Optionally, the fixed shelf has photosensors 50 to detect the presence or absence of non-qualified ink in the cartridges 156–159, a feature not necessary for cartridges containing qualified ink. The cartridges with qualified ink uses the chips 25 to monitor the status of the ink level, but competitor supplied cartridges or competitor refilled cartridges do not have authorized CRUM systems, so to protect the printheads from firing with empty cartridges and damaging the heating elements, the customer must manually confirm the presence of ink in all cartridges or photosensors must be used. The photosensors may be of any suitable type which are well known in the industry. For example, a photosensor may sense the light which passes through the light transmitting cartridge and detect more light when the cartridge is empty than when it contains ink.

The cartridges are depicted with cylindrical shapes, but could have any desired shape. The cartridge neck 166 extends centrally from a relatively flat end surface 168 of the cartridge, and has an opening 169 which is sealingly covered by a cap 170 having a resilient material and a flat thin portion 172 over the neck opening 167. Aligned with each receptacle opening 165 is a fixed needle 174 mounted on a support member 176 and perpendicularly extending therefrom for penetrating the flat thin portion 172 of the cap 170 when the cartridge is installed in the shelf receptacle 164. The end of the needle opposite the one which penetrates the cap is sealingly connected to the tubes 162 for supplying ink to a respective ink manifold 152. Each cartridge has a chip 25 on the cartridge end surface 168, the contact pad thereof couples to a printed circuit board portion 178 which resides on the fixed shelf in each receptacle 164 when the cartridges 156–159 are installed. The full width array printer 140 has a normal print mode and a non-normal print mode and the printer controller thereof (not shown) and chips on the customer replaceable cartridges function is a similar manner as described above for a carriage type printer to determine automatically whether the printer functions in the normal or non-normal printing mode to accommodate a customer in using non-qualified ink in replacement cartridges. The main differences are that the maintenance stations (not shown) for the full width array printer 140 are moved to cap the printhead nozzles of the fixed printheads, and the cleaning blades must traverse the printhead nozzles. In contrast, the maintenance station of the carriage type printer 10 is fixed and the printhead assembly 14 is moved to the maintenance station.

Although the foregoing description illustrates the preferred embodiment, other variations are possible and all such variations as will be obvious to one skilled in the art are intended to be included within the scope of this invention as defined by the following claims. For example, the customer replaceable unit monitoring system of the present invention adjusts the printing mode of the printer automatically from a normal print mode to a non-normal print mode when non-qualified marking material is detected in the customer replaceable cartridge, and would work equally well on any printer, whether it uses liquid or dry marking material or whether the printer is a xerographic copier, facsimile machine, thermal ink jet printer, piezoelectric ink jet printer, or an acoustic ink jet printer.

We claim:

1. A method for adjusting the print mode of a printer using a customer replaceable marking material supply cartridge from a normal print mode to a non-normal print mode in response to a detection of a non-qualified ink in the cartridge by an electronic monitoring system, comprising the steps of:

a) reading an identification number on a customer replaceable marking material supply cartridge after installation thereof in the printer;

b) comparing the identification number which has been read with identification numbers stored in a controller memory of the printer;

c) identifying matches and non-matches between said customer replaceable cartridge identification number and said stored identification numbers d) displaying either a warranty or an out-of-warranty condition on a display panel for the printer, the displayed condition depending upon whether matches or non-matches are respectively identified;

e) causing a non-normal printing mode for the printer when the printer is actuated for printing and an out-of-warranty condition is displayed on the display panel and enabling use of a cartridge having non-matched identification numbers by said printer, the non-normal printing mode having printing parameters adjusted to minimize the effect of non-qualified marking material on the printer; and f) automatically logging a use of a non-normal printing mode in the controller memory of the printer, thus enabling the optional use of a cartridge containing a non-qualified marking material.

2. The print mode adjusting method as claimed in claim 1, wherein the method further comprises the steps of:

(g) determining a marking material level in the cartridge by an electronic monitoring system and displaying an available usage remaining for the customer replaceable marking material supply cartridge on the display panel when the printer is actuated for printing and a warranty condition is displayed;

(h) causing a normal printing mode for the printhead, when the available usage displayed is greater than zero, and preventing the printer from initiating printing under warranty conditions, when the available usage displayed is zero;

(i) converting the warranty condition displayed to an out-of-warranty condition displayed, when the available usage displayed is zero, and changing the identification number on the customer replaceable cartridge to prevent further matches of the cartridge number with the stored identification numbers in the controller memory;

(j) providing an option of printing with a cartridge having a non-matching identification number which has been at least partially refilled with a non-qualified marking material;

(k) enabling the non-normal printing mode for the printer, when the printer is actuated for printing and an out-of-warranty condition is displayed; and (l) automatically logging a use of a non-normal printing mode in the controller memory of the printer.

3. The print mode adjusting method as claimed in claim 2, wherein the printer is an ink jet printer having a printhead assembly with an array of droplet ejecting nozzles which are in fluid communication with the customer replaceable cartridge; and wherein the marking material is liquid ink.

4. The print mode adjusting method as claimed in claim 3, wherein the printhead assembly comprises a printhead and ink flow passageways interconnecting the printhead and the customer replaceable cartridge, the printhead having plurality of ink channels and said nozzles, the channels each being connected to a respective one of the nozzles and having a different refill rate for qualified ink and non-qualified ink, the refill rate for the non-qualified ink being lower than the refill rate for the qualified ink.

5. The print mode adjusting method as claimed in claim 4, wherein the normal printing mode is for printing with qualified ink and comprises a first droplet ejection rate, a first cleaning cycle, a first priming cycle for removal of a first quantity of ink from the printhead, and a first drying time for each printed sheet; and wherein the non-normal printing mode is for printing with non-qualified ink and comprises a second droplet ejection rate less than said first droplet ejection rate to assure an adequate mount of ink is supplied to the nozzles, a second cleaning cycle which comprises the first cleaning cycle and a repeat thereof, a second priming cycle for removal of a second quantity of ink which is greater than the first quantity, and a second drying time greater than the first drying time of said normal printing mode.

6. The print mode adjusting method as claimed in claim 5, wherein the method further comprises the steps of:

(m) photosensing the level of ink in the cartridge containing non-qualified ink to confirm to the printer controller the presence of ink therein; and (n) permitting the printing in the non-normal printing mode by the printer only after the presence of ink in the cartridge has been confirmed, since such non-qualified ink containing cartridges cannot be checked for ink availability by use of the electronic monitoring system provided with cartridges containing qualified ink.

7. The print mode adjusting method as claimed in claim 5, wherein the method further comprises the steps of:

(o) visually observing the presence of ink in a cartridge containing non-qualified ink;

(p) manually pushing the printer's print start button to confirm to the printer controller the presence of non-qualified ink in the customer replaceable cartridge which has been installed in the printer and after an out-of-warranty signal has been displayed on the printer display panel; and (q) permitting the printing in the non-normal printing mode by the printer only after ink is confirmed to be in the cartridge, since cartridges containing non-qualified ink cannot be checked for ink availability by use of the electronic monitoring system provided with cartridges containing qualified ink.

8. The print mode adjusting method as claimed in claim 5, wherein the electronic monitoring system comprises a chip attached to the customer replaceable cartridge which includes an electrically erasable programmable read only memory (EEPROM).

9. The print mode adjusting method as claimed in claim 8, wherein the step of determining the ink level in the customer replaceable cartridge in step (g) is accomplished by counting the droplets ejected from the printhead and when the assigned number representing a printed page is reached, the page is counted and stored in the printer controller memory until the printing is completed, whereupon the total number of pages is summed and decremented from the previously stored number of pages delineated on the chip of the customer replaceable cartridge, so that the number of pages still available from said cartridge after the last printing job is displayed on the printer display panel for the convenience of the customer.

10. A printer utilizing customer replaceable marking material supply cartridges and being adjustable between a normal printing mode and a non-normal printing mode in response to a detection of non-qualified marking material in said cartridges by an electronic monitoring system, comprising:

an electronic monitoring system for reading an identification number on each customer replaceable marking material supply cartridge after installation thereof in the printer and comparing the cartridge identification number with each of a plurality of identification numbers stored in a controller memory of the printer, the electronic monitoring system identifying matches and non-matches between the cartridge identification numbers and the identification numbers stored in the controller memory;

a display panel for displaying a warranty printing condition in response to matches which are identified by the electronic monitoring system and for displaying an out-of-warranty printing condition in response to non-matches which are detected;

means for adjusting the printer either for the normal printing mode when a warranty printing condition is displayed or the non-normal printing mode when an out-of-warranty printing condition is displayed;

said electronic monitoring system having means to display an indication of the number of sheets of recording medium that may be printed by the customer replaceable cartridge when identification number matches are identified and for decrementing the previously indicated number of remaining sheets that are printable by said cartridge after each printing job which is conducted in the normal printing mode, the electronic monitoring system displaying an empty cartridge signal and concurrently terminating operation of the printer when the number of sheets available for printing by said cartridge is zero;

means for enabling the printer to print in the non-normal printing mode when the presence of marking material is confirmed to the printer controller, the non-normal printing mode having printing parameters of the printer adjusted to minimize the effect of using non-qualified marking material on the printer; and means for logging each use of a non-normal printing mode in the printer controller memory.

11. The printer as claimed in claim 10, wherein the printer is an ink jet printer; and wherein the marking material is liquid ink.

12. The printer as claimed in claim 11, wherein the means for enabling the printer to print in the non-normal printing mode comprises a photosensor which detects the presence or absence of ink, the printer being enabled to print when ink is present and prevented from printing when ink is absent.

13. The printer as claimed in claim 11, wherein the means for enabling the printer to print in the non-normal printing mode comprises double pushing a print start button of the printer by a customer after the customer replaceable cartridge has been installed in the printer, indicating that the customer has visually determined the presence of ink in the customer replaceable cartridge and is confirming the presence of ink therein to the printer controller.

14. The printer as claimed in claim 11, wherein the electronic monitoring system comprises a chip attached to the customer replaceable cartridges containing qualified ink, the chip including an electrically erasable programmable read only memory (EEPROM).

* * * * *